US006155071A

United States Patent [19]

Koyanagi

[11] Patent Number: 6,155,071

[45] Date of Patent: Dec. 5, 2000

[54] VENDING MACHINE

[75] Inventor: Takuya Koyanagi, Saitama-ken, Japan

[73] Assignee: Sanyo Electric Co., Ltd., Osaka-Fu, Japan

[21] Appl. No.: 09/401,504

[22] Filed: Sep. 22, 1999

[51] Int. Cl.[7] ..... F25D 3/08; F25D 15/00

[52] U.S. Cl. ..... 62/457.2; 62/237; 62/371; 62/530

[58] Field of Search ..... 62/457.2, 530, 62/465, 382, 371, 237

[56] References Cited

U.S. PATENT DOCUMENTS

| | | | |
|---|---|---|---|
| 3,866,795 | 2/1975 | Urano | 221/150 HC |
| 4,398,651 | 8/1983 | Kumpfer | 221/150 HC X |
| 4,976,112 | 12/1990 | Roberts et al. | 62/457.9 X |
| 5,319,939 | 6/1994 | McFadden et al. | 62/382 X |

FOREIGN PATENT DOCUMENTS

| | | |
|---|---|---|
| 405298544 | 11/1993 | Japan . |
| 407044759 | 2/1995 | Japan . |

*Primary Examiner*—William Doerrler
*Assistant Examiner*—Chen-Wen Jiang
*Attorney, Agent, or Firm*—Sughrue, Mion, Zinn, Macpeak & Seas, PLLC

[57] ABSTRACT

A vending machine according to the invention is easily movable and can be used at a place at which a commercial power supply is not available. Then, it can be installed at a desired place, and can effectively sell articles by certainly catching a chance for sale. The articles contained in a main box of the vending machine are selectively refrigerated or heated by a thermal storage unit, which is previously refrigerated or heated and can be fitted to or removed from the main box. A storage battery is contained in the main box and supplies electric power necessary for driving mechanisms for sale of the vending machine.

7 Claims, 4 Drawing Sheets

VENDING MACHINE

FIELD OF THE INVENTION

The invention relates to a vending machine, and especially to a vending machine which refrigerates or heats articles, such as canned drinks, stores them therein, and sell them to consumers.

BACKGROUND OF THE INVENTION

A conventional vending machine for canned drinks is provided with refrigerating and heating appliances, wherein one of them is selectively driven in accordance with a season, and refrigerated or heated articles are sold to the consumer. Moreover, a refrigerating cycle using refrigerant is adopted as the refrigerating appliances in most cases. The refrigerating cycle is composed of a compressor and an evaporator, which are installed in the vending machine. Air is refrigerated by exchanging heat with refrigerant circulating through the refrigerating cycle, and refrigerated air thus obtained circulates in the vending machine to refrigerate the articles.

However, in the conventional vending machine, since it is necessary to drive the compressor, consumed electric power is large and a commercial power supply of 100V is needed. Moreover, since the refrigerating cycle comprising the heavy compressor is installed therein, the conventional vending machine becomes heavy and large-sized. Accordingly, the conventional vending machine is fixedly installed at the storefront at which the commercial power supply is available in most cases. If it is once installed, it is very difficult to remove the conventional vending machine to another place because of necessity for securing the commercial power supply and restrictions due to weight and dimensions thereof.

On the other hand, the demand for sale of the articles by the vending machine is not entirely for all seasons, and there are many requests to limit the time for sale of the articles by the vending machine. For example, since the times when a skiing ground, a bathing beach, a festival or a place of an event is crowded with people are limited, the article can be effectively sold, if the vending machine is installed in such a place only in the aforementioned times. However, since the conventional vending machine has no mobility, it cannot meet such a request.

SUMMARY OF THE INVENTION

Accordingly, it is an object of the invention to provide a vending machine which is easily movable, can operate without a commercial power supply, can be installed at a desired place, and certainly catches a chance for sale of articles.

According to the feature of the invention, a vending machine comprises:

- a thermal storage unit, which is previously refrigerated or heated to selectively refrigerate or heat articles contained in a main box of the vending machine, and can be fitted to or removed from the main box, and
- a storage battery, which is contained in the main box and supplies electric power necessary for driving selling mechanisms of the vending machine.

In the vending machine according to the invention, a thermal storage unit (a coolness retaining unit and a warmth retaining unit) is previously refrigerated or heated, and fitted to the main box of the vending machine. The articles in the main box of the vending machine are refrigerated or heated by exchanging heat with the thermal storage unit. Since the thermal storage unit can be fitted to and removed from the main box, when the useful life of the thermal storage unit has passed, the thermal storage unit is exchanged with the other thermal storage unit which has been already refrigerated or heated, and thereby a refrigerating or heating condition can be continued. As mentioned in the above, since the article can be refrigerated or heated only by the thermal storage unit, a refrigerating cycle which comprises a compressor and has been used in the conventional vending machine becomes unnecessary. As a result, consumed electric power can be saved, and the vending machine becomes light-weighted and small-sized.

The selling mechanism is supplied with electric power from a built-in storage battery, performs various operations necessary for sale, and sells the articles. Since electric power necessary for selling the articles can be supplied from the storage battery, the commercial power supply becomes unnecessary. As a result, the vending machine according to the invention can be installed at a place selected at will conjointly with an improvement of mobility due to light weight and small size thereof. For example, the vending machine can be timely installed at a place which is crowded with people at a particular time, and thereby effectively sell the articles by certainly catching a chance for sale.

In this case, it is desirable that the thermal storage unit is composed of a container which can be fitted to and removed from the main box of the vending machine and a thermal storage medium enclosed in the container.

In this structure, since the thermal storage unit is formed into a cassette, actual handlings in cases of refrigerating or heating and fitting to or removing from the main box become easy.

In this case, it is desirable that the main box of the vending machine is provided with an open area at the front thereof and the container of the thermal storage unit is composed of a front wall and two side walls extending backward from the both side edges of the front wall. Accordingly, the container has a squarish U shaped horizontal cross-section, and surrounds the articles contained in the main box by the front wall and the two side walls, when the container is inserted into the main box through the open area of the main box.

According to the aforementioned structure, the thermal storage unit can be simply fitted to or removed from the main box by pushing or pulling the cassette through the open area formed at the front of the main box.

Moreover, in the aforementioned case, it is desirable that the door is fitted to the main box so that the door is rotational around the lower edge of the main box and maintains a horizontal position, when the door is opened.

According to the aforementioned structure, the door being opened and maintaining the horizontal position can be used as a base of the thermal storage unit in case that it is fitted to and removed from the main box, and the thermal storage unit can be easily fitted to and removed from the main box by sliding it along a lower edge of the door.

In the aforementioned cases, it is desirable that the container of the thermal storage unit is provided with grips for fitting or removing it.

In the aforementioned structure, the thermal storage unit can be easily fitted to and removed from the main box by gripping the grips provided for the container.

In the aforementioned cases, it is desirable that the main box of the vending machine is provided with castors for supporting the vending machine so that it is movable.

In the aforementioned structure, the vending machine can be easily moved by the castors.

In the aforementioned case, it is desirable that the main box of the vending machine is provided with a handle for manually carrying the vending machine.

In the aforementioned case, movement of the vending machine becomes further easy because of the handle and the castors.

In the aforementioned case, it is desirable that the terminal for charging the storage battery is provided for the main box at an outer wall thereof.

According to the aforementioned structure, the storage battery can be easily charged without taking out the storage battery from the main box by using the terminals provided for the main box at an outer wall thereof.

BRIEF DESCRIPTION OF THE DRAWINGS

The invention will be explained in more detail in conjunction with appended drawings, wherein.

DESCRIPTION OF THE PREFERRED EMBODIMENT

Figure 1:
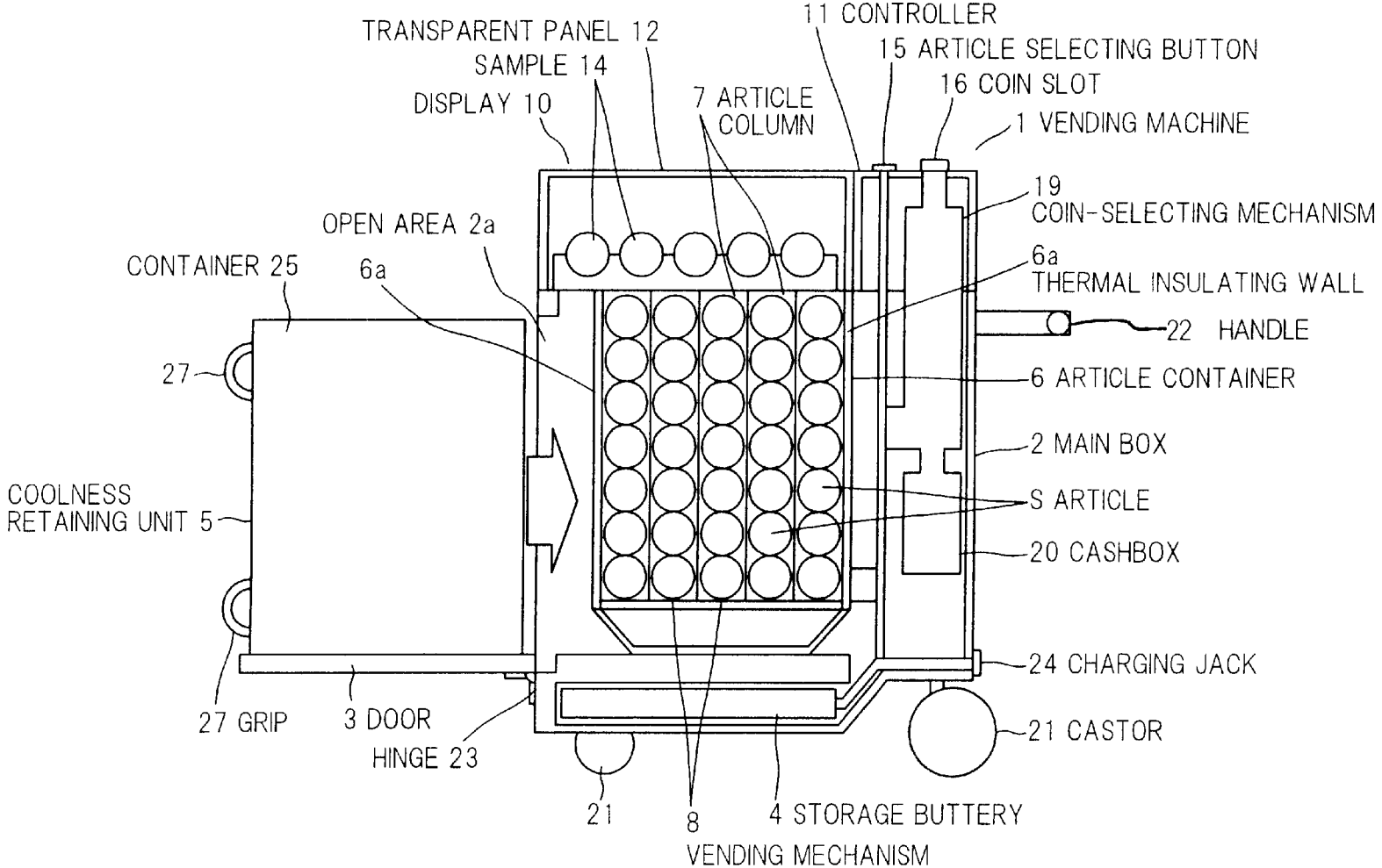
FIG. 1 shows an inner structure of a vending machine according to a preferred embodiment of the invention, FIGS. 2A, 2B and 2C respectively show a front view, a top view and a right side view of a vending machine shown in FIG. 1, FIGS. 3A, 3B and 3C respectively show a front view, a plan view and a right side view of a coolness retaining unit used in a vending machine shown in FIG. 1.

Thereafter, a preferred embodiment of the invention will be explained referring to appended drawings. FIG. 1 and FIGS. 2A, 2B and 2C show a vending machine according to the invention. The vending machine is used for sale of articles, such as refrigerated canned drinks, and is more compact than an ordinary vending machine of this kind. For example, dimensions thereof are that a width W=25 cm, a depth D=70 cm and a height H=90 cm.

The vending machine 1 is provided with a main box 2, a door 3 for opening or shutting an open area 2*a* in the front, a storage battery 4 serving as a power supply of the vending machine 1, and a coolness retaining unit 5 (a thermal storage unit).

As shown in FIG. 1, an article container 6 having thermal insulating walls 6*a* in front and back is formed in the main box 2, and the article container 6 is separated into five articles columns 7 extending in a vertical direction. The articles S are contained in the article container 6 in a condition that the articles S having the same brand are stacked up in the same article column 7. At the lowest edge of the article column 7, a vending mechanism 8 is provided, and at the time for sale, the article S is sent off from the article column 7 by the vending mechanism 8 and conveyed to an exit 9 for sale formed on the right side of the main box 2.

On the top of the main box 2, a display 10 and a controller 11 are respectively provided near the front and the rear of the main box 2. The display 10 is formed of a display room having a transparent panel 12 thereon, in which five samples 14 of the articles are arranged in a horizontal direction. The number 13 assigned to the article S is stamped on the sample 14. On the controller 11, five article-selecting buttons are arranged in the lateral direction. On the article-selecting buttons 15, numbers which are respectively the same as the numbers 13 of the samples 14 of the articles are expressed. Behind the article-selecting buttons 15, a coin slot 16, a coin-returning button 17 and an indicator 18 for indicating amount of coins thrown into the vending machine are situated. A consumer sees the samples 14 of the articles through a transparent panel 12, decides the article S to be bought, throws coins of necessary amount into the coin slot 16, and selects the article by pushing the article-selecting button 15 with the same number as that of the sample of the article S to be bought.

As shown in FIG. 1, a coin-selecting mechanism 19 for examining the genuineness of the coins thrown thereinto and a cashbox 20 for receiving the coins are situated at the rear of the main box 2, and the amount of the coins examined by the coin-selecting mechanism 19 is indicated on the indicator 18.

Castors 21 are fixed to the four corners of a bottom surface of the main box 20, and a handle 22 for manually driving the vending machine 1 is fitted to the left and right side surfaces of the main box 2 at upper parts thereof so that the vending machine 1 is easily movable. A rotation-locking mechanism (not shown) is provided for the castors 21 at the rear side, and thereby the vending machine 1 can be stabilized at a position to which it is moved.

Figure 2A:
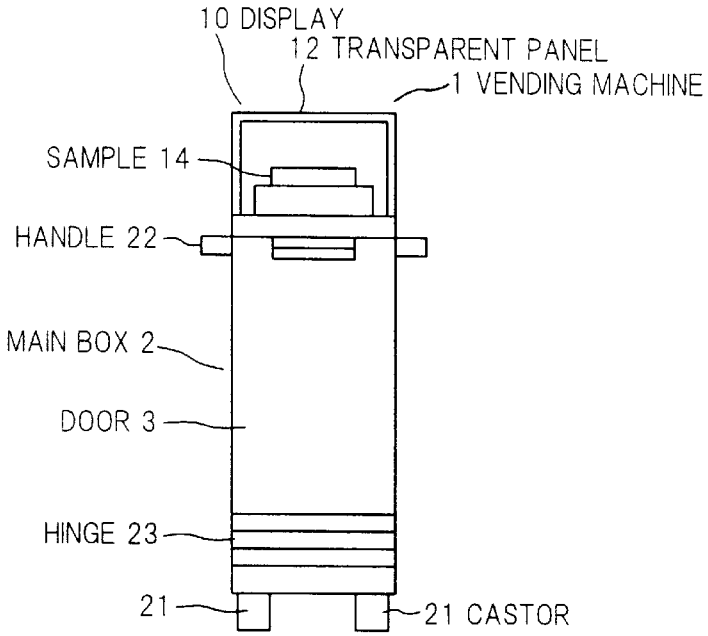
Figure 2B:
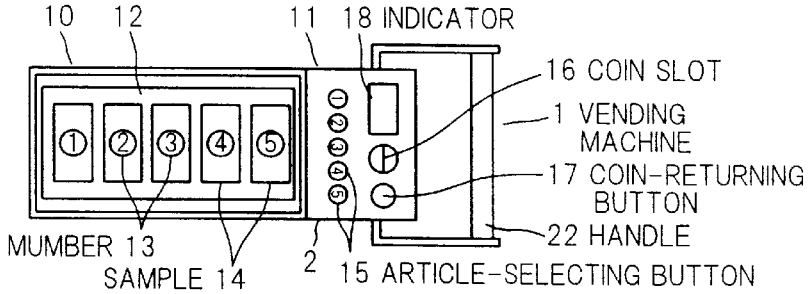
Figure 2C:
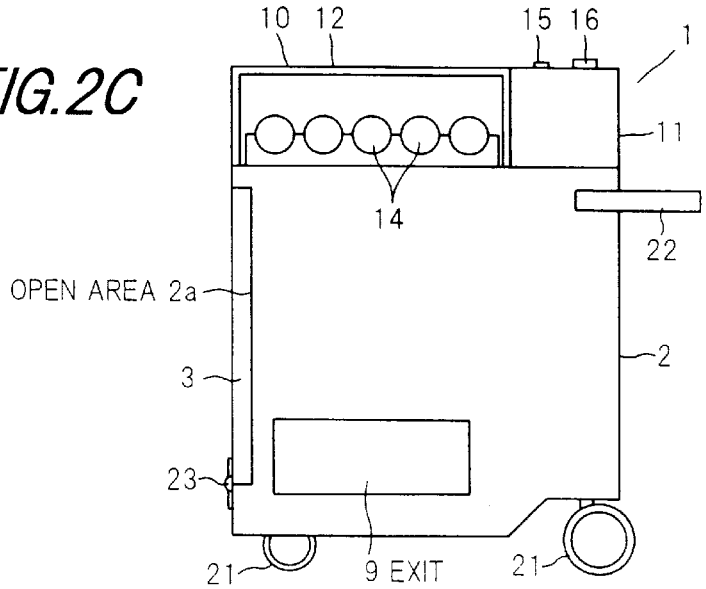
Figure 3A:
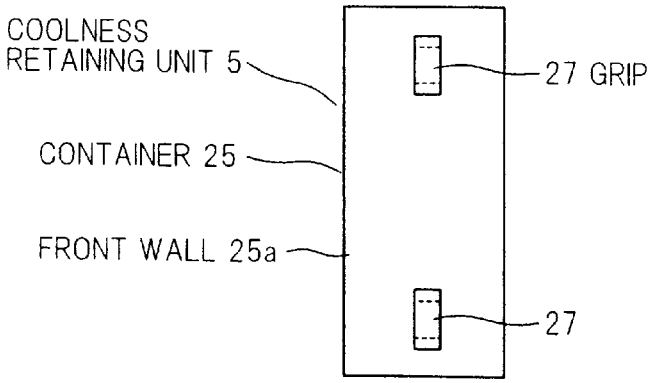
Figure 3B:
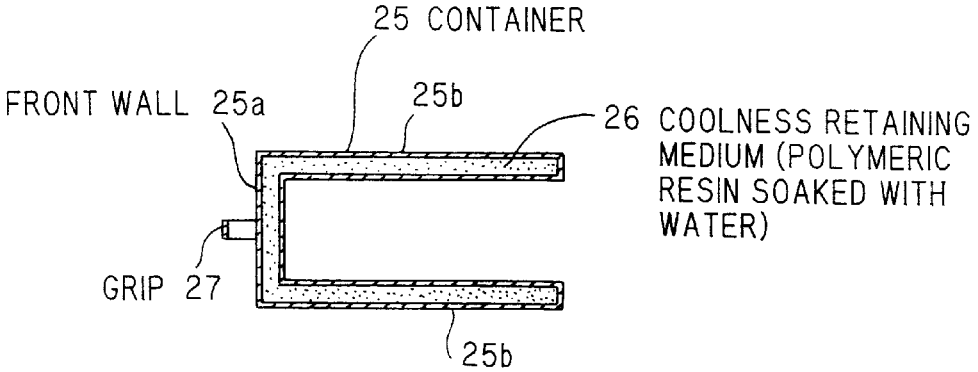
Figure 3C:
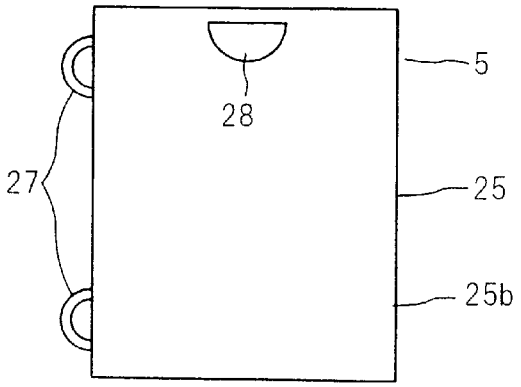
Figure 4:
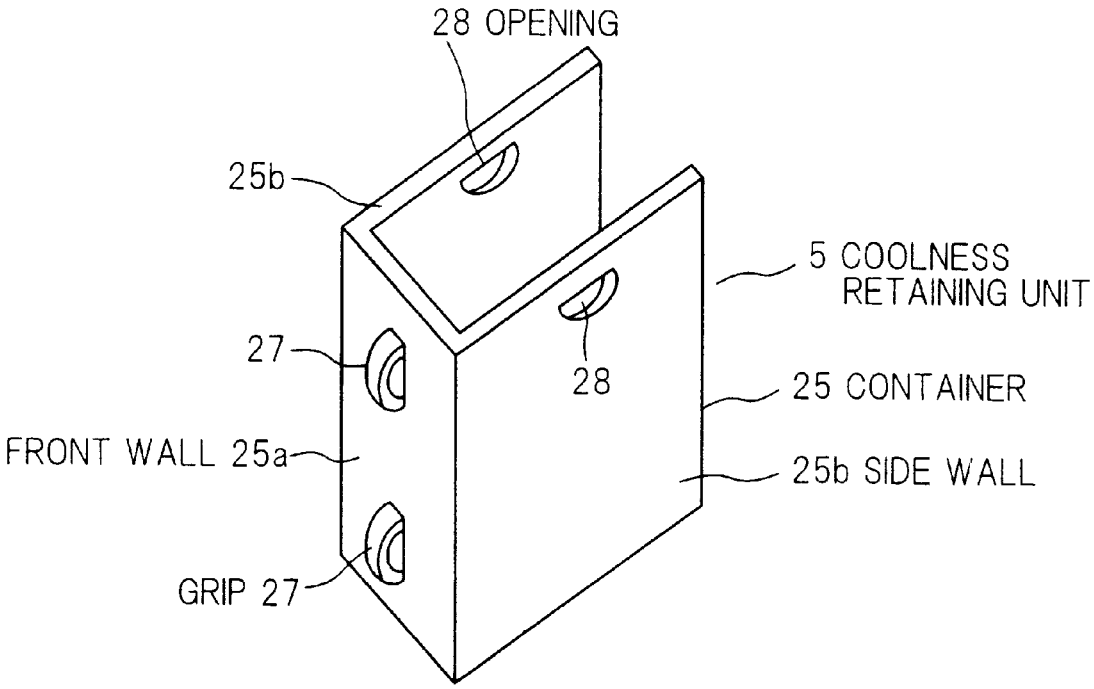
FIG. 4 shows a perspective view of a coolness retaining unit shown in FIGS. 3A to 3C.

The door 3 is fitted to the lower edge of the main box 2 by means of a hinge 23 so that the door can be rotated therearound between a "shut" position shown in FIG. 2C and an "opened" position shown in FIG. 1. In this way, the door 3 opens or shuts the open area 2*a* of the main box 2. Moreover, when the door 3 rotates to the "opened" position, a further rotation is obstructed by a mechanism (not shown) arranged in the hinge 23, and the door 3 maintains a horizontal position.

As shown in FIG. 1, the storage battery 4 is contained in the bottom of the main box 2, and electrically connected with the vending mechanism 8, the display 18 and the coin-selecting mechanism 19, and supplies electric power to them. Moreover, the storage battery 4 is connected with a charging jack 24 provided at the lowest edge of the rear surface of the main box 2, and can be easily charged via the charging jack 24 from the outside.

As shown in FIGS. 3A, 3B, 3C and 4, a coolness retaining unit 5 is composed of a container 25 and a coolness retaining medium 26 (FIG. 3B) to be enclosed in the container 25, and formed into a cassette. The container 25 is exclusively designed for the vending machine 1, formed of polypropylene resin, and manufactured by integral molding. The container 25 is composed of a front wall 25*a* and side walls 25*b* and 25*b* which extend backward from both side edges of the front wall 25*a*, and is so formed that it has a squarish U shape horizontal cross-section having predetermined dimensions. On the front wall 25*a* of the container 25, two circular arc shaped grips 27 for fitting or removing the coolness retaining unit 5 are formed at higher and lower parts thereof, and two semicircular openings 28 for gripping are formed on upper parts of the side walls 26 and 26.

The coolness retaining medium 26 is formed of polymeric resin soaked with water, and previously refrigerated till it is solidified. The coolness retaining unit 5 is fitted to the main box 2 of the vending machine 1. The coolness retaining unit 5 maintains its refrigerating capability for a predetermined useful life (12 hours, for instance) and refrigerates the articles S in the main box 2 at a predetermined refrigerating temperature.

The aforementioned vending machine is used as follows. First, the coolness retaining unit 5 is sufficiently refrigerated till the coolness retaining medium 26 is solidified. Next, after the articles S are stacked up in the article columns 7, the refrigerated coolness retaining unit 5 is carried to a place near the vending machine 1. This carriage is easily performed by gripping the openings 28 and 28 formed on the side walls 25*b* and 25*b* by both hands. Next, as shown in FIG. 1, the coolness retaining unit 5 is set on the door 3 in condition that the door 3 is opened at the "opened" position and maintains the horizontal position by the hinge 23. Then, the grip 27 formed on the front wall 25*a* is gripped, the coolness retaining unit 5 is slid on the door 3, pushed into the main box 2 of the vending machine 1 as shown by an arrow in FIG. 1, and fitted thereto. At this time, the articles S are surrounded by the front wall 25*a* and the side walls 25*b* and 25*b* of the coolness retaining unit 5. Then, the door is shut as shown in FIG. 2C. Thereafter, the vending machine 1 is carried to a position to be installed by the castors 21 and the handle 22, and settled thereon by means of a rotation-locking mechanism of the casters 21 so that it is not movable therefrom. In this way, the installation of the vending machine 1 and the preparation of sale are completed.

When the cooliness retaining unit 5 is fitted to the main box 2, the articles S are gradually cooled by exchanging heat with cooled atmosphere generated by liquefaction of the coolness retaining medium 26. When a predetermined time has passed, the temperature of the articles falls to a predetermined value (5° C., for instance), the articles S becomes suited for sales, and the vending machine 1 is for sale of the articles S. As mentioned in the above, the refrigerated condition continues for a useful life (12 hours, for instance) of the coolness retaining unit 5.

While the vending machine 1 is for sale of the articles S, if a consumer selects the article S by pushing the article-selecting button 15, the coin-selecting mechanism 19, the indicator 18 and the vending mechanism 8 operate in accordance with a predetermined program for sale by being supplied with electric power from the storage battery 4, the selected article S is sent off from the article column 7 and conveyed to an exit 9 for sale.

As mentioned in the above, according to the vending machine according to the embodiment, since the articles S can be refrigerated by the coolness retaining unit 5, the refrigerating cycle comprising the compressor used in the conventional vending machine becomes unnecessary, consumed electric power can be saved, and the vending machine can be light-weighted and small-sized. Moreover, since electric power necessary for driving the vending mechanism 8 and etc. can be supplied only from the storage battery 4, the commercial electric power supply becomes unnecessary. As a result, the vending machine can be easily carried to a desired position. Accordingly, the vending machine 1 according to the invention can be timely installed at a place which is crowded with people at the particular times, certainly catches a chance for sale, and effectively sells the articles. Moreover, the movement of the vending machine 1 can be easily performed by the castors 21 and the handle 22 for carriage.

Since the coolness retaining unit 5 is formed into a cassette, it is convenient for actual handling, and easily fitted to or removed from the main box 2 of the vending machine 1 by pushing or pulling it. In this case, since the grips 27 are formed on the coolness retaining unit 5 and the door 3 maintaining a horizontal position at the "opened" position can be used as a base for sliding the coolness retaining unit 5, works for fitting to or removing from the main box 2 can be further easily performed. As mentioned in the above, the coolness retaining unit 5 is fitted to the main box 2 so that it surrounds the articles S by the front wall 25*a* and the right and left side walls 25*b* and 25*b*, it can effectively exchange heat with the articles S.

In case that a period for sale is long and the end of the useful life is coming, the refrigerating capability of the coolness retaining unit 5 deteriorates. However, in case that the period of sale is short and within the useful life of the coolness retaining unit 5, the vending machine 1 is removed before its useful life has passed. On the other hand, in case that the period for sale is longer than the useful life of the coolness retaining unit 5, the coolness retaining unit 5 fitted to the main box 2 of the vending machine 1 can be simply exchanged with the other refrigerated coolness retaining unit 5, and sale can be continued without hindrance.

The invention is never restricted to the aforementioned embodiment, and can be applied to an embodiment of the different mode. For example, although a thermal storage unit is used as the coolness retaining unit 5 and the refrigerated articles S are sold in the aforementioned embodiment, application of a warmth retaining unit can be devised as the second preferred embodiment of the invention. That is to say, sodium acetate is used as a warmth retaining medium, and forms the warmth retaining unit together with a container to fabricate the thermal storage unit, which is previously heated, fitted to the main box 2 of the vending machine 1 and heats the articles S for sale.

Although the explanation is mainly given for case that the vending machine is installed at a place which is crowded with people in the particular time, mobility of the vending machine according to the invention is effectively exhibited to be used in a train running on a railroad. Hitherto, a large-sized vending machine is fixedly installed in the train, and supplement of the articles is performed in a short stoppage time at the terminal station in most cases. However, the vending machine according to the invention can be set at a narrow space, and the vending machine used till now can be easily exchanged with a vending machine of the invention because of mobility thereof. Moreover, since a time of the train between the starting and final stations is shorter than the useful life of the thermal storage unit in usual cases, maintenance of the vending machine in the train is quite unnecessary.

As mentioned in the above, since the vending machine according to the invention is easily movable and can be used at a place on which the commercial power supply is not available, it can be installed at a desired place and can effectively sell the articles by certainly catching the chance for sale.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A vending machine, comprising:

a main box.

a thermal storage unit comprising a container and a thermal storage medium enclosed in said container, said thermal storage unit being previously refrigerated or heated to selectively refrigerate or heat articles contained in said main box, wherein said thermal storage unit is fitted to or removed from said main box, and the container and the enclosed thermal storage medium surrounds the articles when the container is fitted to said main box, and a storage battery contained in said main box, said storage battery supplying electric power necessary for driving selling mechanisms of said vending machine.

2. A vending machine according to claim 1, wherein:

said main box includes an open area formed at a front side and a door for opening or shutting said open area; and said container comprises a front wall and two side walls extending backward from both side edges of said front wall, wherein said container has a squarish U shaped horizontal cross-section, and is inserted into said main box through said open area thereof to be fitted to said main box.

3. A vending machine according to claim 2, wherein:

said door is fitted to said main box at a lower edge thereof whereby said door is rotatable around said lower edge and maintains a horizontal position when said door is opened.

4. A vending machine according to claim 1, wherein:

said container of said thermal storage unit includes at least one grip for fitting and removing said thermal storage unit.

5. A vending machine according to claim 1, wherein:

said main box of said vending machine includes castors whereby said vending machine is movable.

6. A vending machine according to claim 5, wherein:

said main box of said vending machine further includes a handle for manually moving said vending machine.

7. A vending machine according to claim 1, wherein:

said main box of said vending machine includes terminals for charging said storage battery on an outer wall thereof.

* * * * *